United States Patent [19]

Ohmori

[11] 4,044,719

[45] Aug. 30, 1977

[54] DEVELOPING APPARATUS IN ELECTRO-COPYING MACHINES

[75] Inventor: Hitoshi Ohmori, Mino, Japan

[73] Assignee: Rank Xerox Ltd., London, England

[21] Appl. No.: 709,034

[22] Filed: July 27, 1976

[30] Foreign Application Priority Data

Nov. 6, 1975 Japan ..... 50-132429

[51] Int. Cl.[2] ..... G03G 15/08

[52] U.S. Cl. ..... 118/652; 118/658; 118/612; 355/3 DD

[58] Field of Search ..... 118/637, 600, 644, 657, 118/612, 651, 658, 653; 355/3 DD; 427/20, 21; 222/109

[56] References Cited

U.S. PATENT DOCUMENTS

| | | | |
|---|---|---|---|
| 2,786,440 | 3/1957 | Giaimo | 118/637 |
| 3,168,022 | 2/1965 | Limberger | 222/109 |
| 3,357,399 | 12/1967 | Fisher | 118/637 |
| 3,700,142 | 10/1972 | Waibel | 222/109 |
| 3,943,887 | 3/1976 | Smith | 118/637 |

*Primary Examiner*—Henry S. Jaudon
*Attorney, Agent, or Firm*—Earl T. Reichert

[57] ABSTRACT

To insure that fresh toner dispensed into a magnetic brush developing apparatus is thoroughly stirred and mixed with developer which has been stripped from a magnetic roll, the member used to strip the developer from the roll is disposed beneath the toner dispensing opening, and is formed from two inclined plates joined together by a spring to form a continuous inclined surface extending from the roll, the lower plate being connected to a vibration generator.

2 Claims, 3 Drawing Figures

FIG. 1
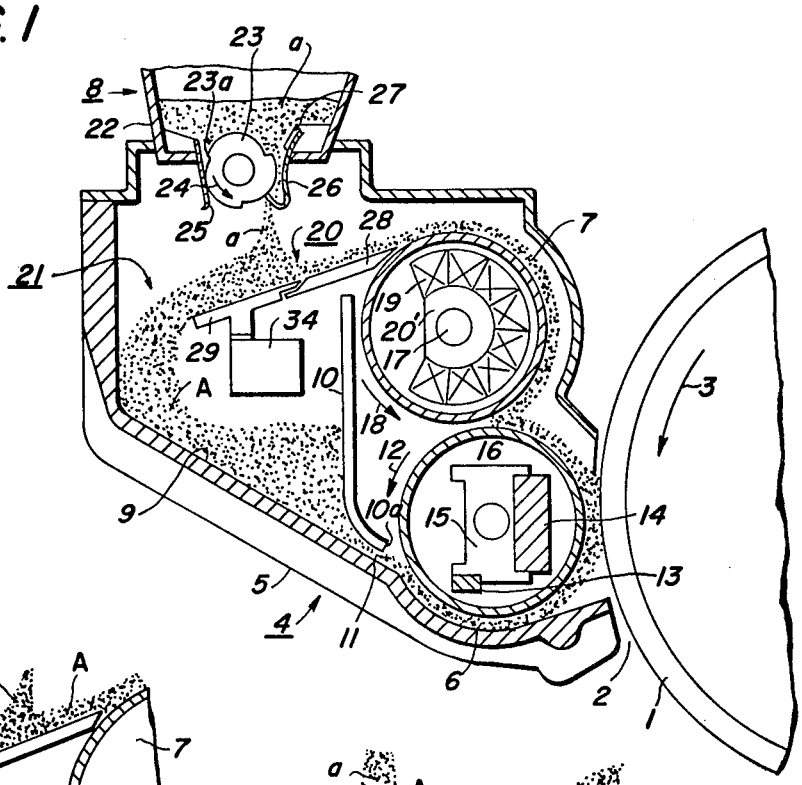
FIG. 2
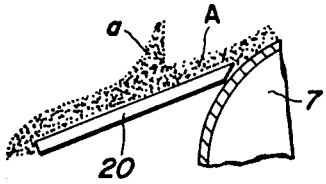
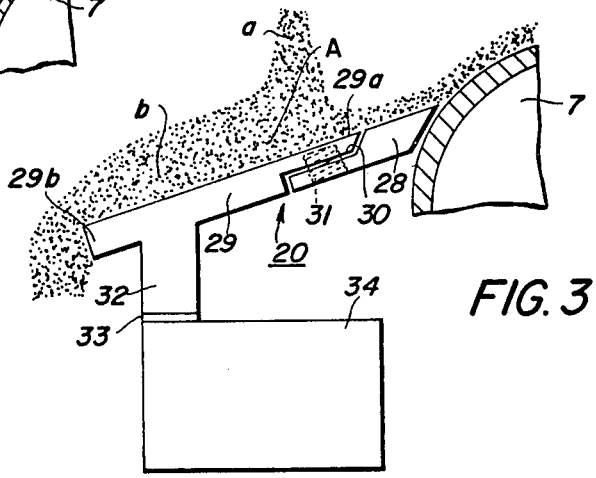
FIG. 3

DEVELOPING APPARATUS IN ELECTRO-COPYING MACHINES

BACKGROUND OF THE INVENTION

This invention relates to developing apparatus in electrophotographic copying machines, and more specifically, to a magnetic brush developing apparatus in electrophotographic copying machines, characterized by a stirring and mixing device, in which both developer stripped from a magnetic roll after development, and newly supplied toner are stirred and mixed.

In electrophotographic copying machines, developer composed of a mixture of a colored fine powder called toner and a body called a carrier is used to turn a latent image of an original formed on a photosensitive body of a photoconductive insulating material into a visual image in a development process. Only the toner in the developer is used to develop the latent image, however, and the carrier is recovered, and hence, the toner is gradually used up as a number of copies are made. Because of this, toner must be added to the developer from a toner supplying device.

Fresh toner supplied from the toner supplying device is electrostatically bonded to the carrier in the developer by frictional contact, and therefore both toner and carrier must be efficiently stirred and mixed.

In the event that the electrostatic charge between the toner and the carrier is insufficient, that is, the effect obtained by stirring toner and carrier is insufficient, they will be attracted to the magnetic roll without being sufficiently stirred. As a result, toner is deposited even in the background areas of the latent image, and the copy obtained is poorly formed and contaminated.

The magnetic brush developing apparatus is often limited in size, however, particularly a magnetic developing apparatus for a small electrophotographic copier. Consequently, the developer is not sufficiently stirred and mixed with the fresh toner, resulting in the problem described above.

SUMMARY OF THE INVENTION

It is an object of the present invention to provide a developing apparatus in an electronic copying machine, in which toner and carrier may be sufficiently stirred and mixed even if the distance for movement and the head of the developer is small. To effect this a vibrator is connected to a stripping member so that stripped developer is thoroughly stirred and mixed with newly added toner supplied from above the stripping member.

BRIEF DESCRIPTION OF THE DRAWINGS

FIG. 1 is a sectional view of an embodiment of the present invention.

FIG. 2 is a view of a conventional stripping member.

FIG. 3 is an enlarged view of the stripping member shown in FIg. 1.

DETAILED DESCRIPTION OF THE INVENTION

In FIG. 1, a photosensitive drum 2 having a photoconductive insulating layer 1 is rotated as indicated by the arrow 3 and is in a condition where uniform charging and image illumination of an original have already taken place.

a developing device 4 is entirely protected by a frame 5 and includes a developing magnetic roll 6, a developer conveying magnetic roll 7, and a toner supplying device 8.

Developer A is slidably moved down along a fixed inclined surface 9, which forms a frame for the developing device, and moves downwardly onto the developing magnetic roll 6 through an orifice 11 formed by the inclined surface 9 and a lower surface 10*a* of a longitudinal flow control plate 10, the flow rate thereof being controlled by the orifice 11.

The developing magnetic roll 6 is rotated in the direction of the arrow 12, and is provided with a magnetic 13 for attracting the developer A dropped and supplied through the orifice 11 onto the surface thereof, a magnet 14 for forming the brush-like fibers of a magnetic brush at a development position, and a holder 15 for holding the aforesaid magnets. A support shaft 16 rotatedly supports the magnetic roll 6.

The other developer conveying magnetic roll 7 is rotated about a shaft 17 in the direction of the arrow 18 and is provided with a group of magnets 19 and a holder 20' for holding the group of magnets 19.

The developer A, the flow rate of which is controlled by the orifice 11, is attracted to the developing magnetic roll 6, and the brush-like fibers formed by the magnet 14 at the development position slidably rub against a latent image on the surface of the photosensitive drum 2, after which the developer A is conveyed by the conveying magnetic roll 7 to a stripping plate 20 and deposited into a developer reservoir 21 at the rear of the developing device 4.

The toner supplying device 8 is provided to add a suitable amount of tone *a* to the developer A, a toner container box 22 serving to hold a supply of fresh toner. As a toner supply roll 23 rotates in the direction of the arrow 24, the toner *a* is metered between a groove 23*a* and a baffle 25 after which the toner *a* in the groove 23*a* is scraped off by the tip of a blade 26. The blade 26 has one end secured to a fixed portion 27 since it has to serve as a spring.

FIG. 2 illustrates a conventional stripping member 20 in a prior art developing device. Stripping member 20 is a plate which is smooth and inclined so that the developer A stripped from the conveying magnetic roll 7 drops in the form of a flow almost close to a laminated flow along the plate, i.e., no variation is made with respect to vertical and lateral positional relationship of developer A.

Because of this, toner *a* dropped toward the flow of developer A is not at all stirred and mixed with the developer A, thereby resulting in the problem discussed above.

In the developing device of the present invention, however, the stripping plate 20 is divided into a sharp-edge stripping member 28 and a vibration guide plate 29 to form divided surfaces 30. The latter surfaces are placed in contact with each other by means of a spring 31 retained between the stripping member 28 and the vibration guide plate 29, the vibration guide plate having a leg 32 connected to a vibration generator 34 which generates vertical and lateral vibrations through a spring 33.

Thus, as developer A stripped by the stripping member 28 reaches the vicinity of tip 29*a* of the vibration guide plate 29, the vibration generator 34 causes the developer A to move violently in all directions, whereby the developer comes into complete random contact with newly supplied toner *a* to provide frictional charge between the toner *a* and a carrier *b* for electrostatic bonding. The developer A continues its violent irregular movement up to a rear end 29b of the vibration guide plate 29 where it is deposited into the developer reservoir 21.

It should be noted that the stirring and mixing of developer A and supplied toner *a* may be further increased by machining the surface of the vibration guide 29 in contact with the developer A so as to have a roughened surface.

From the foregoing, it will be appreciated that with the present invention, stripped developer A is vibrated by the vibration plate 20 and toner *a* can be supplied from above so that the developer A and toner *a* may be moved with respect to each other to provide efficient frictional charge between the toner *a* and the carrier *b* in the developer A, thereby facilitating electrostatic bonding to achieve sufficient stirring and mixing as well as solving unevenness of rate of toner *a* contents within the developer A. Thus, even in case the distance of movement and the head of developer are small, the toner and carrier may sufficiently be stirred and mixed, and the present invention provides a developing device well suited for a small type electrophotographic copying machine.

While the invention has been described with reference to the structure disclosed, it is not confined to the details set forth, but is intended to cover such modifications or changes as may come within the scope of the following claims.

What is claimed is:

1. An improved developing apparatus for transporting developer from a reservoir past a photoreceptor to develop electrostatic latent image on the latter, the apparatus including:

a magnetic roller mounted adjacent the photoreceptor, a stripping member extending away from the magnetic roller and downwardly toward the reservoir for stripping excess developer from the magnetic roller and returning it to the reservoir, the stripping member including a first flat plate having one edge located immediately adjacent the magnetic roller, a second flat plate, and means biasing the plates into contact with each other to form a continuous surface inclined downwardly from the magnetic roller toward the reservoir whereby excess developer is returned to the reservoir, means located above the stripping member for dispensing toner onto the stripping member, and means connected to the second flat plate for vibrating the latter to stir and mix stripped developer and newly supplied toner together.

2. An improved developing apparatus as set forth in claim 1, wherein the surface is roughened.

* * * * *